US005294110A

United States Patent [19]

Jenkins et al.

[11] Patent Number: 5,294,110

[45] Date of Patent: Mar. 15, 1994

[54] PORTABLE GOLF SHOT ANALYZER AND CLUB SELECTOR

[76] Inventors: James J. Jenkins; Dean R. Jenkins, both of 4 Banook Ave., Darthmouth, N.S., Canada, B3A2L4

[21] Appl. No.: 966,882

[22] Filed: Oct. 27, 1992

[51] Int. Cl.[5] ..... A63B 69/36

[52] U.S. Cl. ..... 273/32 H; 273/32 R

[58] Field of Search ..... 273/32 R, 32 A, 32 B, 273/32 H, 35 R, 183.1, DIG. 26; 364/410, 411; 434/252

[56] References Cited

U.S. PATENT DOCUMENTS

| | | | |
|---|---|---|---|
| 3,671,724 | 6/1972 | Sanders | 273/183.1 |
| 4,136,394 | 1/1979 | Jones et al. | 273/32 H |
| 4,220,992 | 9/1980 | Blood et al. | 273/183.1 |
| 4,815,020 | 3/1989 | Cormier | 273/32 H |
| 4,864,854 | 9/1989 | Van Leemput | 273/32 H |
| 4,910,677 | 3/1990 | Remedio et al. | 273/32 R |

FOREIGN PATENT DOCUMENTS

| | | | |
|---|---|---|---|
| 2004080 | 3/1992 | PCT Int'l Appl. | 273/32 H |

*Primary Examiner*—Jessica J. Harrison
*Attorney, Agent, or Firm*—H. Jay Spiegel

[57] ABSTRACT

An instrument and method for teaching and training individuals to achieve accuracy and efficiency in playing the game of golf. The instrument permits electronic reading and recording of atmospheric pressure, optical reading and manual recording of both the distance from the current ball position to the pin and the vertical distance of the current ball position above or below the pin, optical estimating and recording of the forward slope and the sideways slope as well as the manual estimating of turf conditions at the ball positions. The instrument also permits the user to manually estimate and record the most critical result of wind direction and velocity through a device which processes this information with a standardized methodology in conjunction with predetermined and recorded club trajectory information for the particular user to determine and display the pre-shot alignment of the particular user, and the post-shot position of the ball in relation to the pin.

11 Claims, 10 Drawing Sheets

Conditions at STP – No. Wind
Scale – One unit is 20yds

Conditions at STP No Wind
Scale – One unit is 20yds

Scale – one block is 20yds.

Solid Line – Pressure at STP
Dotted Dash – Pressure below STP Trajectories Based
Dashed Line – Pressure above STP on Five Iron Scale – One unit is 20yds Trajectory Based on 5 Iron Sidehill Lie Birds eye view Scale - One unit is 40yds
Dotted Line indicates
roll after initial impact Sidehill Lie Side view Solid - No sidehill lie
Broken - ball is below feet
Dotted Broken - ball is above feet Scale-One unit is 20yds
Trajectory Based on Five Iron Solid - No hill
Broken - Uphill
Dotted Broken - Downhill Solid - Zero rough
Broken - 1/4 rough
Broken Dotted - 1/2 rough
Broken Double Dotted - 3/4 rough
Dotted - Full rough Wind Birds eye view Solid - No Wind
Broken - 10mph Winds
From SW Scale-One unit is 25yds

PORTABLE GOLF SHOT ANALYZER AND CLUB SELECTOR

BACKGROUND OF THE INVENTION

The present invention relates to a portable golf shot analyzer and club selector. This invention relates to the game of golf, and more particularly to a method and apparatus useful in determining the correct shot to play.

The game of golf is played by using one of a number of clubs to drive a ball as close as possible to the pin. Along with the skill to correctly hit the ball, it is necessary for the player to know the distance which the ball is to travel and the effects of existing conditions for which he or she must compensate to acquire the desired shot.

In the past the most common procedure in determining the shot to play was to visually and mentally estimate the remaining distance, then to observe other effects like wind, lies, and rough and to then guess their effects on the shot and adjust accordingly. Because all of these judgments are made from past experiences, there is often doubt as to which shot to play. It is rare that a player is confronted with a shot for which identical past experience exists. This leads to confusion in the player's mind. The result is often incorrect choices of shots, and increase of tension, with diminished results.

It is therefore an object of the present invention to provide the method for correct shot selection which will in turn remove physiological and psychological barriers with the result of removing unnecessary tension and therefore restoring the player's natural ability. It will also teach and train the user of the invention the effects of optical illusions, the importance and awareness of the other conditions (factors), with the objective of speeding up the play while at the same time lowering the player's score.

The following prior art is known to Applicant:

U.S. Pat. No. 3,671,724 to Sanders discloses a golf game computer including means for approximating the effects of backspin on range. The computing system of Sanders includes means for calculating the free flight trajectory of a golf ball struck from a tee having backspin imparted thereon and includes a backspin corrector for modifying the calculated distance of the golf ball to simulate the effects of backspin. The present invention differs from the teachings of Sanders as contemplating inputting all of the various actual conditions with regard to the location of a golf ball, analyzing them in light of the capabilities of the user, and choosing the appropriate club while indicating where a ball hit with that club will land.

U.S. Pat. No. 4,136,394 to Jones et al. discloses a golf yardage indicator system which relies upon a remote unit which may transmit a radial pulse to a base unit located at the flag stick of the golf hole. The remote unit measures the time interval between transmission of the radial pulse and reception of an ultrasonic signal in response thereto to calculate distance. The remote unit also receives input of wind conditions. The present invention differs from the teachings of Jones et al. as including a yardage indicator which does not require interaction with the flag stick. In the present invention, an optical range-finding device is incorporated therein to allow determination of distance to pin manually.

U.S. Pat. No. 4,220,992 to Blood et al. discloses a portable event analysis device which includes means for allowing inputting of the various parameters of shots which have already been made in a game of golf so that the game may be later analyzed. The present invention differs from the teachings of Blood et al. as being intended to be used to allow the user to input the various conditions and to be assisted in choosing the appropriate club for each shot.

U.S. Pat. No. 4,815,020 to Cormier discloses a method and apparatus for computing golf game parameters. The device utilizes a wheel rolling along with the golfer from the tee to the ball location to determine the yardage already travelled and uses triangulation to determine the actual distance to pin. The present invention avoids the need for such a wheel by utilizing a built-in range-finding mechanism to determine distance to pin.

U.S. Pat. No. 4,864,854 to vanLeemput discloses a device designed to aid a golfer in selecting a club including the use of a wind velocity and direction indicator. The present invention differs from the teachings of vanLeemput as permitting inputting of all potential parameters, manual determination of range, and consideration of the particular actual results of the user with the various clubs.

SUMMARY OF THE INVENTION

The present invention relates to a portable golf shot analyzer and club selector. In accordance with the present invention, an electronic device is provided which has three memories, manual input devices, a microprocessor, a display screen, and three interface ports. One memory semi-permanently stores the user's personal statistics containing information pertaining to the distance which he can drive a golf ball with various clubs. The second memory permanently holds information pertaining to particular ball flight-paths for each club. The third memory temporarily holds calculations to find the best suited shot selection for the conditions entered into the device at that time. Calculations include combined factors of current physical conditions entered by the user along with the effects of atmospheric pressure and known information from the first and second memories.

The device includes a keypad and a selection center for manual input of present conditions including: uphill lie with varying degrees, downhill lie with varying degrees, sidehill lie with varying degrees, position of the ball in relation to the golfer's feet (above or below), wind direction, wind speed, and degree of rough. A range-finder is also provided to optically determine the distance between the ball and the pin. A clinometer is provided to calculate the degree of lies as well as the difference in the vertical position between the ball and the pin for cases when the pin may be situated in higher or lower elevations in relation to the ball's position. This is used in calculating the true trajectory to the pin.

Accordingly, it is a first object of the invention to provide a portable golf shot analyzer and club selector.

It is a further object of the present invention to provide such a device including a range-finder to optically determine the distance between the ball and the pin as well as a clinometer to calculate the angle of the particular lie as well as the difference in the vertical position between the ball and the pin.

It is a still further object of the present invention to provide such a device including means for receiving information for storage concerning the particular results of the user with each club in the golf bag.

It is a still further object of the present invention to provide such a device allowing calculation of wind direction, wind speed and degree of rough.

These and other objects, aspects and features of the present invention will be better understood from the following specific description of preferred embodiments when read in conjunction with the appended drawing figures.

SPECIFIC DESCRIPTION OF THE PREFERRED EMBODIMENT

Figure 3:
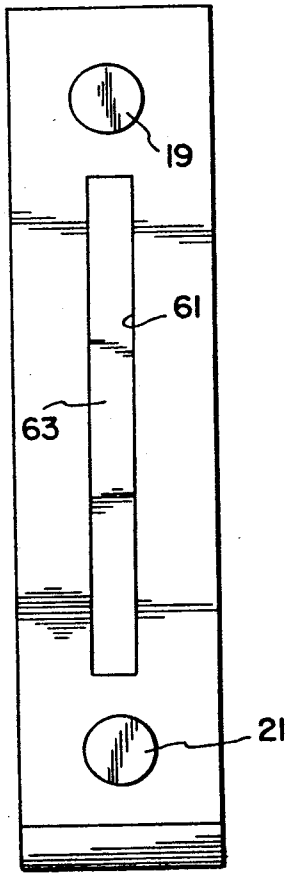
FIG. 3 shows a view from the other side of the device illustrated in FIG. 1.
Figure 2:
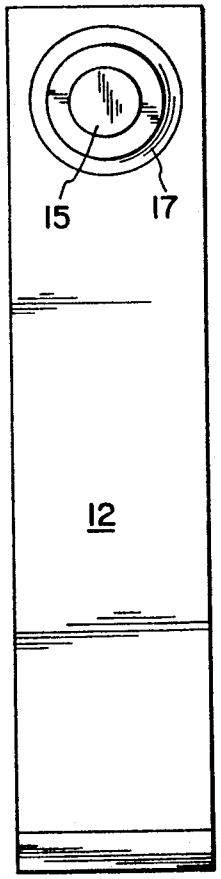
FIG. 2 shows a side view of the device illustrated in FIG. 1.
Figure 1:
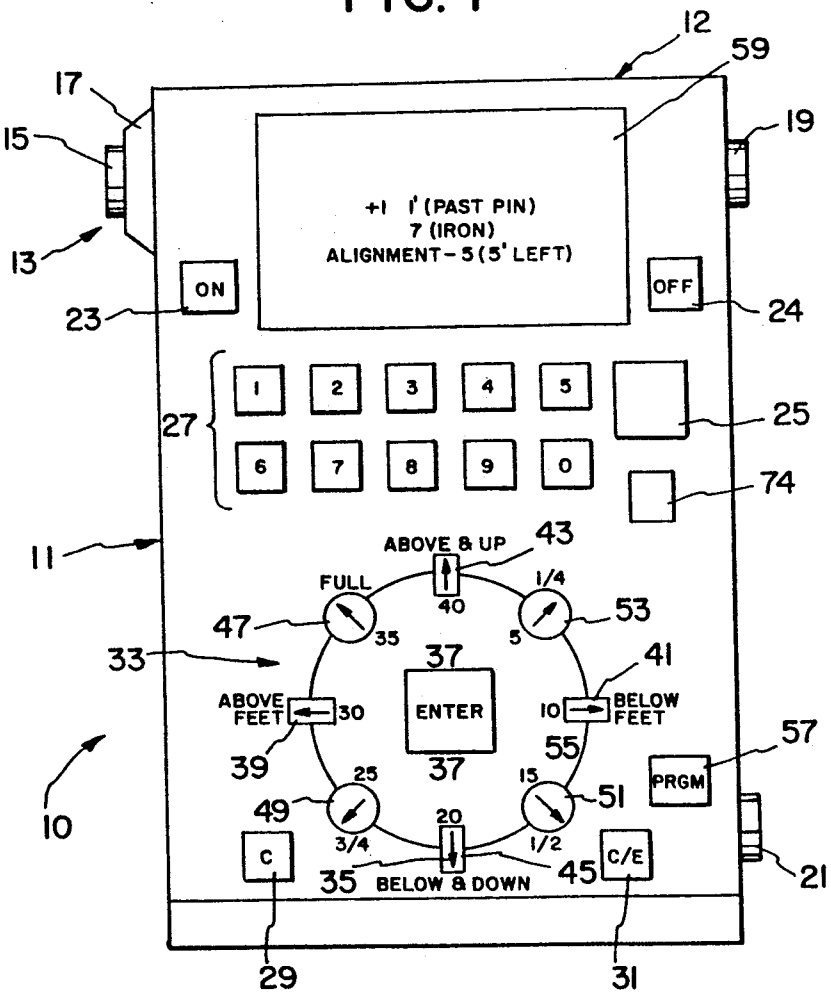
FIG. 1 shows a view looking downwardly on the front face of the housing of the inventive device.

FIGS. 1-3 show the preferred embodiment of the housing 12 and the control panel 11 of the inventive device 10. The device contains an optical range-finder and clinometer 13. The clinometer and range-finder information are displayed on the focusing eyepiece 15 by mechanical means. A rotational focusing dial 17 on the lens allows the user to adjust the range-finder to display the current distance. Lenses 19, 21 are optically connected to the eyepiece 15 through the housing 12 of the device 10. The range-finder and clinometer are well known in the prior art and are only considered inventive herein with regard to their specific manner of integration within the housing 12.

On and off buttons 23 and 24 respectively control power to the various device functions. A built-in temperature, pressure and humidity sensor 25 reads local atmospheric pressure, temperature and humidity, and sends the data to the central processing unit within the housing 12 in the form of an electric signal provided for data processing when such data is needed. The signal is constantly sent, but only when the data is needed for club selection will the CPU read the data from the sensor 25.

With particular reference to FIG. 1, on the face 11 of the device are two keypads, a standard numeric keypad 27 complete with clear 29 and clear error 31 keys, and a selection center keypad 33 featuring buttons representing wind direction, direction of lie, position of feet above or below the ball, position of pin above or below the ball, degree of rough, degree of lie, and wind speed. These categories are divided among the eight buttons and are clearly labeled in FIG. 1. The arrows 35 on the buttons show the wind direction they represent for the wind direction step of club selection. The numbers 37 to the inside of the buttons represent degree of lie, either up/downhill or sidehill, for use in carrying out degree of lie steps. The left-most and right-most buttons 39 and 41, respectively, also serve to designate whether the ball is above the user's feet (39) or below the user's feet (41) in a sidehill lie. The top-most 43 and bottom-most 45 buttons similarly also serve to designate both pin elevation and direction of lie. The upper button 43 represents uphill lie and a pin that is above the ball. The lower button 45 represents a downhill lie, and a pin that is below the ball. The corner or diagonal buttons also represent degrees of rough, with full rough being the upper left button 47 moving counterclockwise to three-fourths rough on the lower left 49, one-half on the lower right 51, and one-fourth on the upper right 53. In the center of these buttons is the Run/Enter button 55 for starting the club selection function, starting auxilliary functions, and entering data to memory. The program button 57 initiates the programming function for storing club distances. Output by the device is displayed on a LCD screen 59 large enough to display five lines thirty characters long each, and produces adequate monochrome resolution graphics for other applications. Port 61 on the side of the housing (FIG. 3) allows access for CD ROM data and a ROM cartridge 63 as will be explained hereinafter.

Figure 4:
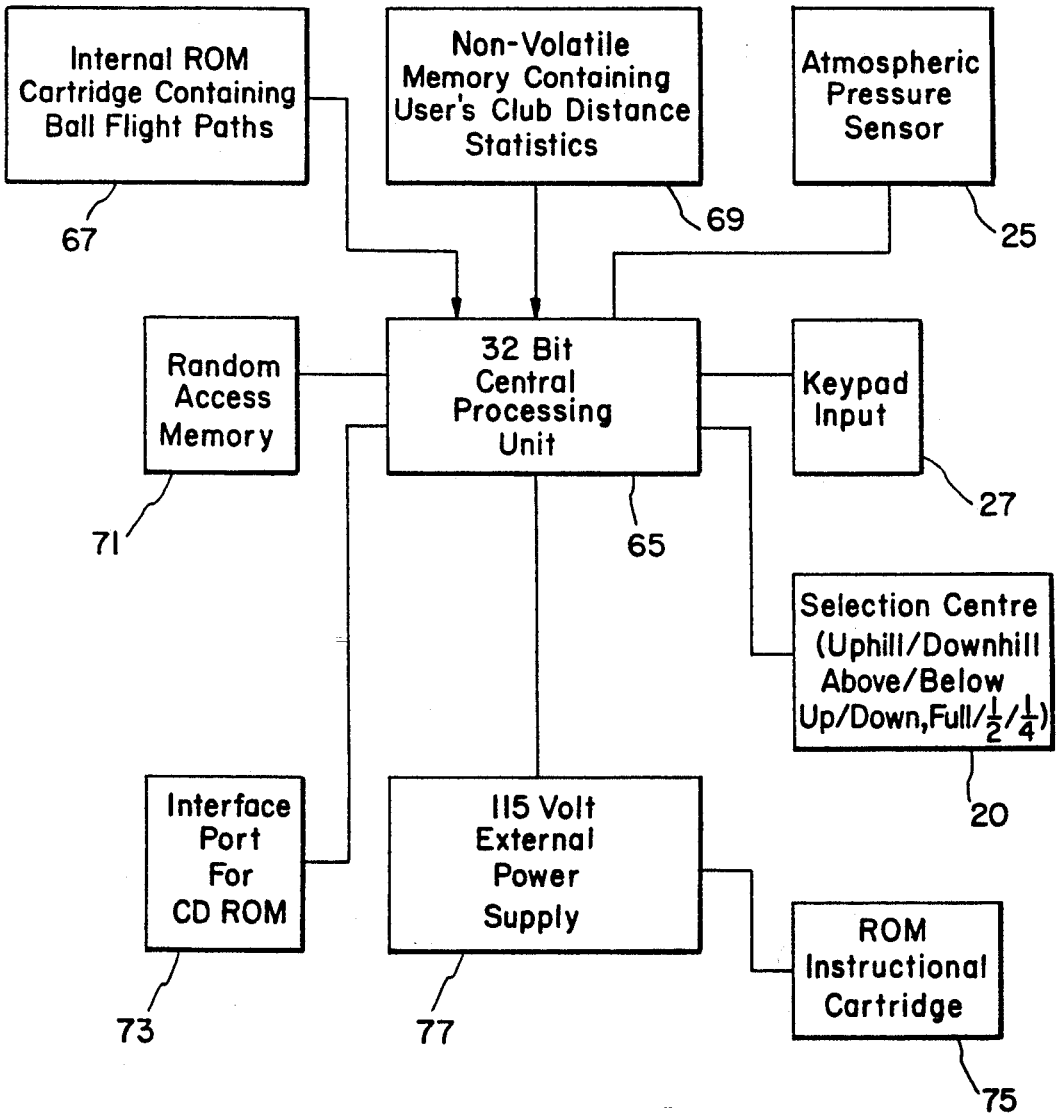
FIG. 4 shows a schematic representation of the electrical circuitry of the present invention.

FIG. 4 shows a schematic of the electronic circuitry within the device 10. As noted before, the ambient conditions sensor 25, the numeric keypad 27 including on/off buttons and clear/clear error buttons, and the selection center 33 including enter and program buttons input data to the 32 bit Central Processing Unit, or CPU 65 where all mathematical functions are carried out as the CPU 65 is preprogrammed. The CPU 65 accesses typical ball flight paths, or trajectories, from an internal ROM (Read Only Memory) cartridge 67. ROM information is permanent and stays even when there is no power. The user's club distance statistics determined through experimentation with each club are stored in a non-volatile memory store 69 also accessed by the CPU. The non-volatile memory will not be erased if the power is turned off, but can be changed. Temporary data, such as intermediate trajectories used by the club selection function, are stored in the Random Access Memory, or RAM 71. RAM data will disappear if the power is turned off.

Additional auxiliary functions send instructions through the CD ROM 73 or ROM cartridge 75 ports. Both of these sources are for applications of instructional nature, and have been designed for in-house-use only. The CD ROM 73 features instructional videos stored on CD format. A specialized CD player using AC current is necessary to read the CDs. The CD player sends the data to the device and the device which processes the data, and the device sends the data to a television set for display. The ROM cartridge port 75 requires an additional 115 volt external power supply 77 to ensure it is not used on the course, as the applications are instructional or entertainment in nature, and inappropriate for use during play, as are the CD ROM applications. ROM cartridge applications include a series of technique instruction videos similar to the CD ROM. Another application is an electronic video golf game. The golf game uses existing features such as using the user's own club range statistics and showing what club should have been used in an approach shot and where it should have been aimed after the user had made the shot, in order to teach proper club selection.

The basis of club selection is a series of mathematical models representing the flight of the ball hit by each club. These flight paths, or trajectories, are stored as generalized equations, and are defined by ultimate distance the ball will travel. Factors such as direction of wind, speed of wind, direction of lie, degree of lie, and degree of rough will all have known effects on the trajectories. The device will combine the effects and fully define the trajectory of a ball hit by the user with any club. An elevated or recessed green will shorten or extend the complete flight path, and cause the vertical distance to become shorter or longer. The device makes a club selection by comparing the trajectories of all the clubs and the distance to be hit. The trajectory that would place a ball closest to the pin without falling short is selected, as it is easier to take distance off of a shot than it is to put extra distance on one. Further, because a shot less than 100 yards often requires a wedge, the pitching wedge has four subdivisions for accuracy, full swing, three-fourths swing, one-half swing, and one-quarter swing. Full swing is defined as being capable of hitting a ball the full distance the user is able, three-quarters swing is three-quarters of full distance, and so on. FIGS. 8–15 display the trajectories taking into account the above-described parameters. The corresponding mathematical formulae are programmed into the Internal ROM cartridge 67.

As the club of choice will most likely overshoot the pin, the CPU 65 is programmed to calculate the distance the trajectory of the ball using the chosen club will carry the ball past the desired distance, and displays it so the user may appropriately compensate. This is done for the wedge "subswings" as well.

Some factors, such as sidehill lie and sidewinds, will tend to make the ball curve to the sides. To aid the user, the device calculates the distance the trajectory will take the ball to the left or the right, and tells the user via the display 59 to aim that distance to the opposite side to compensate.

To be useful, the device must be programmed with the user's actual club ranges, or the distance the user can hit the ball with all of the various clubs. The data for all of the user's club comprise one data store. The device will feature ten complete such data stores so the user may let friends, family, or partners utilize the device without having to alter the user's data.

Figure 5:
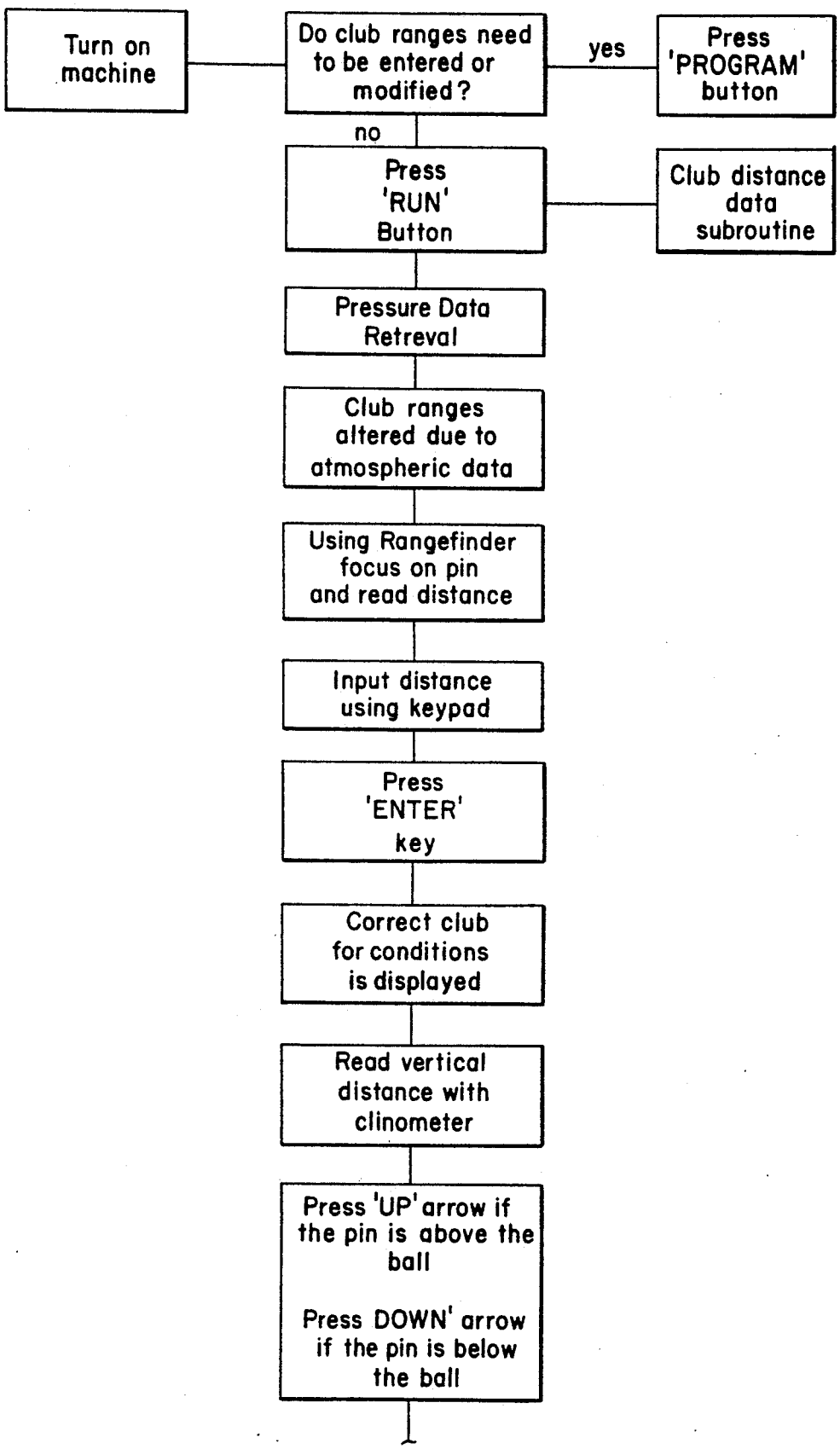
FIGS. 5, 6 and 7, when combined together, explain the sequence of operation of the inventive device.
Figure 6:
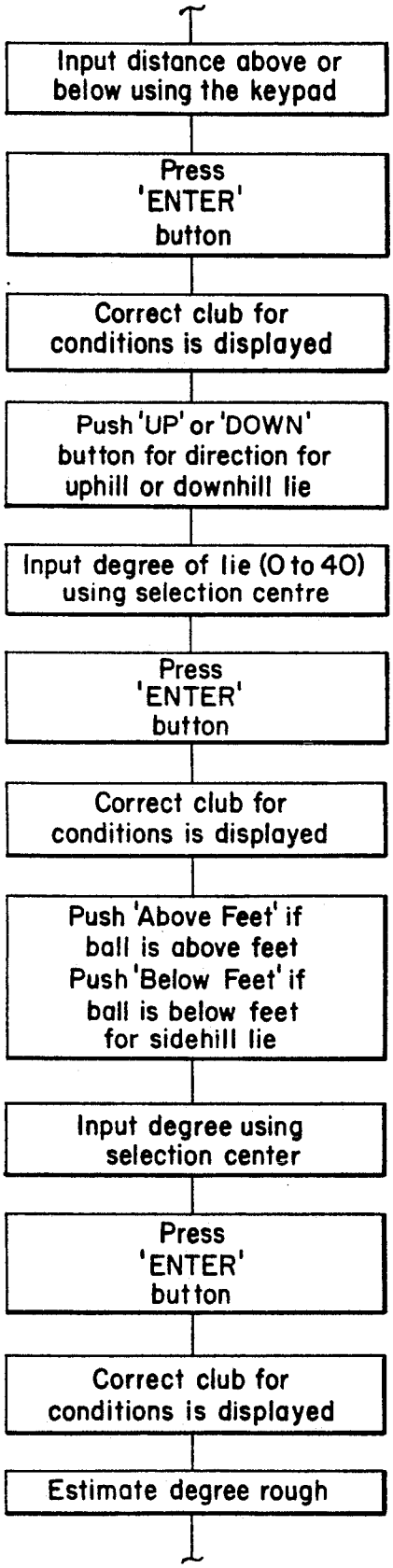
Figure 7:
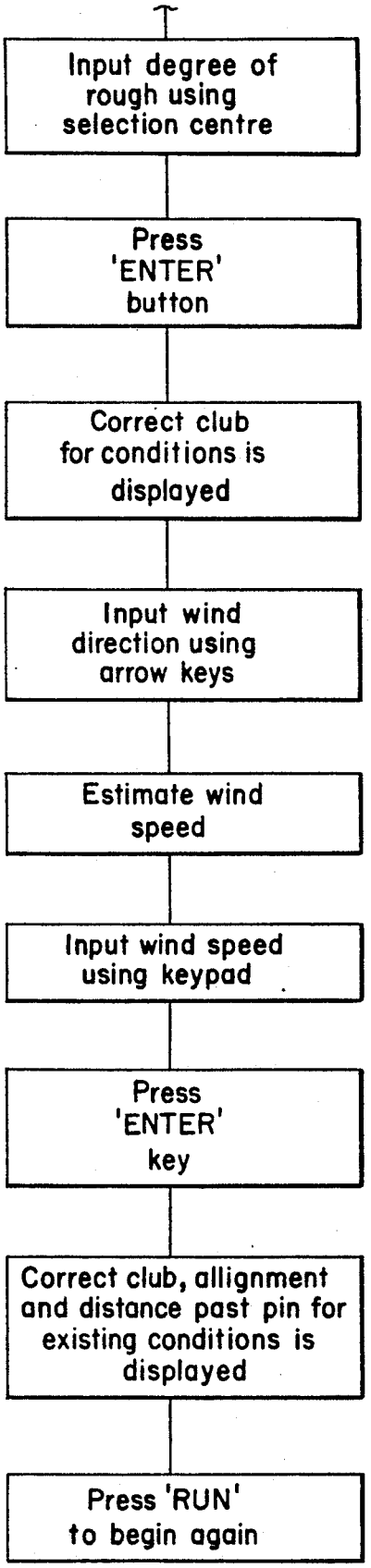
Figure 8:
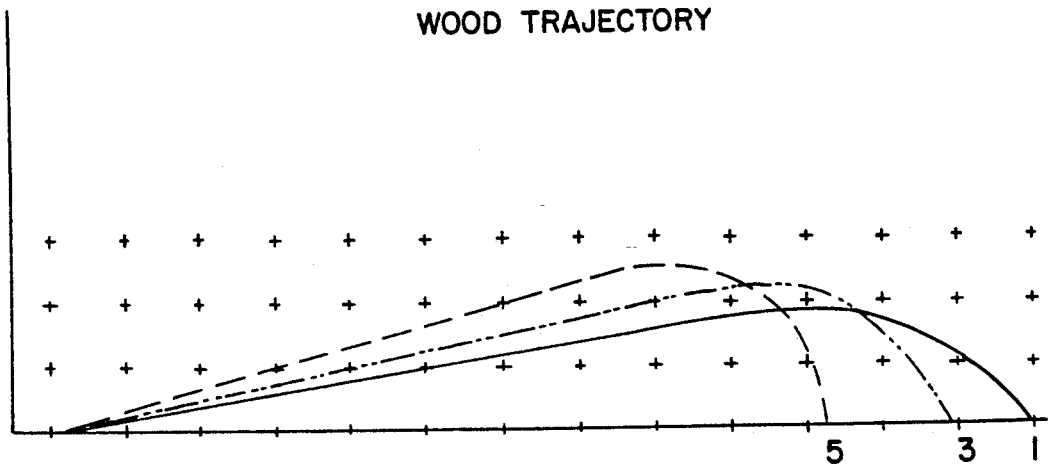
FIG. 8 shows a graph of typical trajectory of golf balls hit using the wood clubs shown, at standard temperature and pressure with no wind present.
Figure 9:
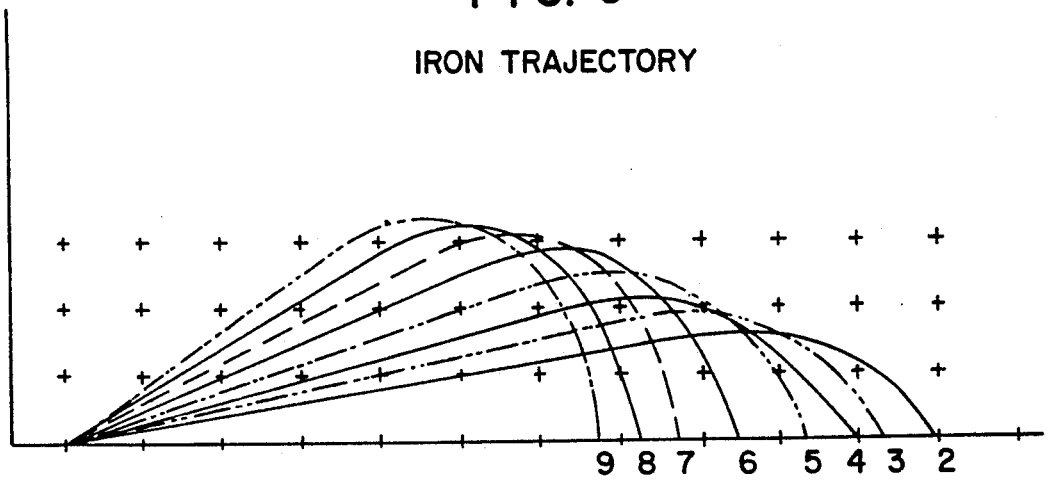
FIG. 9 shows the typical trajectory of golf balls hit using the "irons" as indicated at standard temperature and pressure with no wind.
Figure 10:
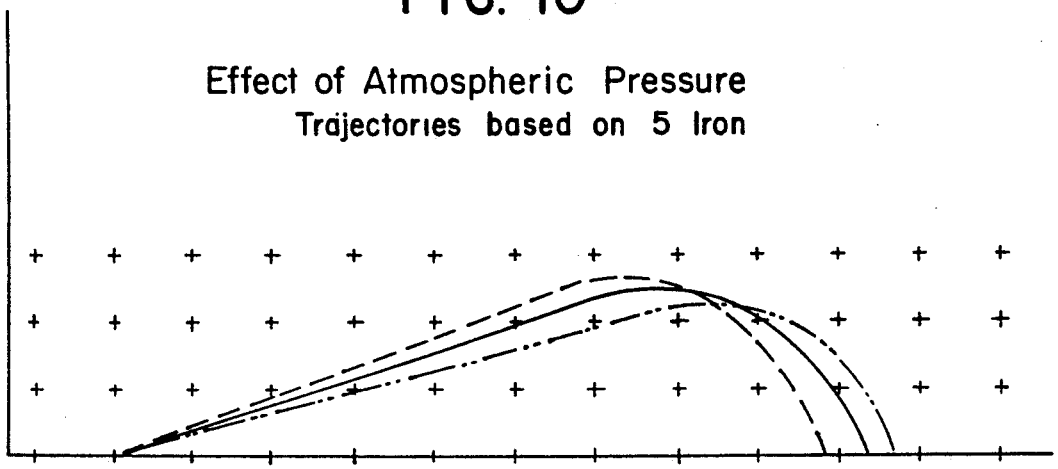
FIG. 10 shows the effect of variations in atmospheric pressure on the trajectory of a golf ball hit with a five iron.
Figure 11:
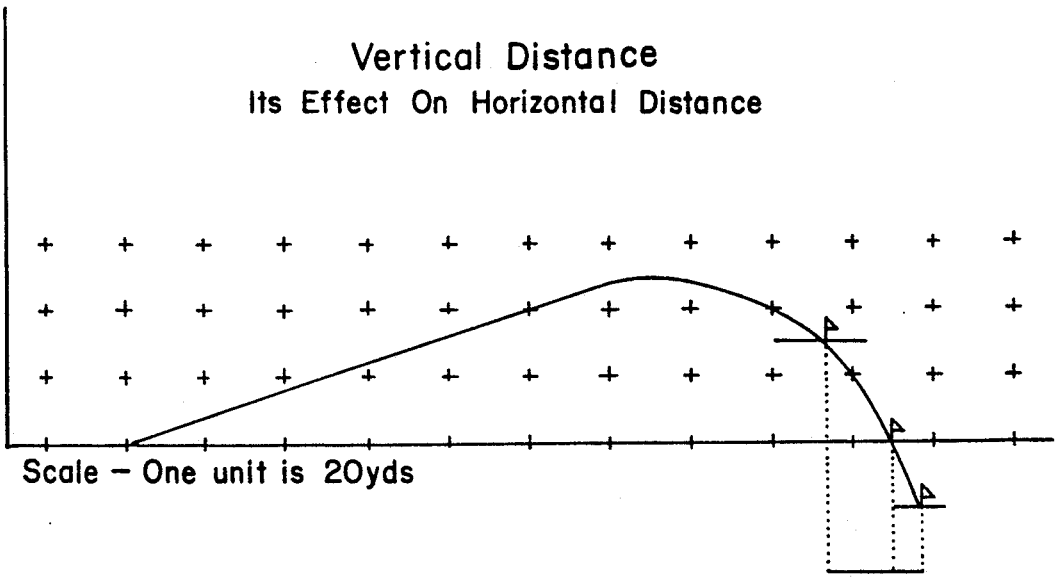
FIG. 11 shows the effect on horizontal distance of elevation of the pin above or below the elevation of the location of the ball.
Figure 13A:
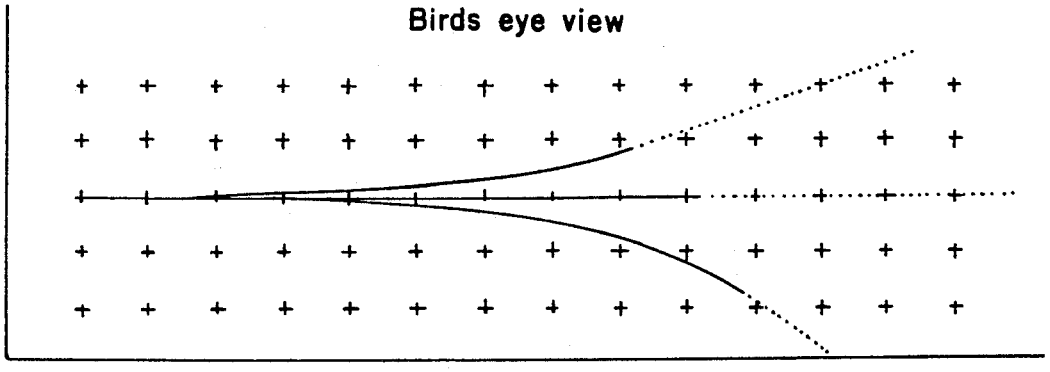
FIG. 13A and 13B show the effect on a shot trajectory of different sidehill lies.
Figure 13B:
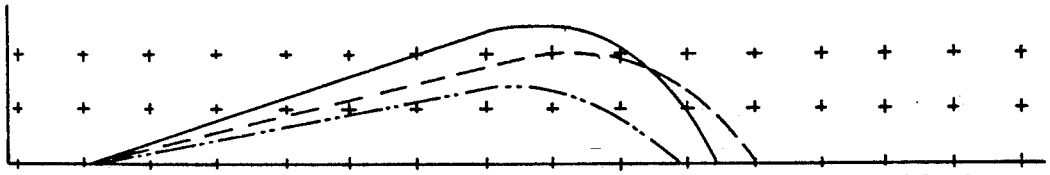
Figure 12:
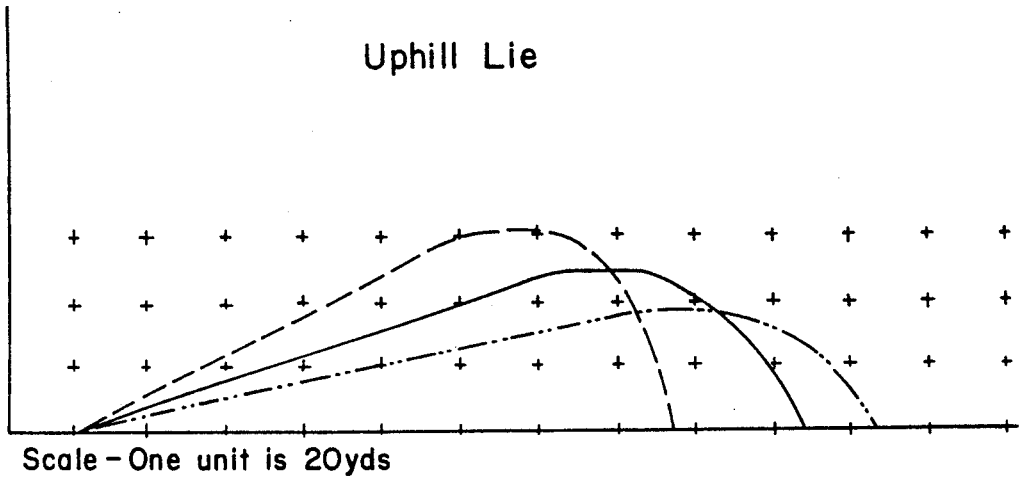
FIG. 12 shows the effect on trajectory of the lie of the ball, whether flat, uphill or downhill.
Figure 15:
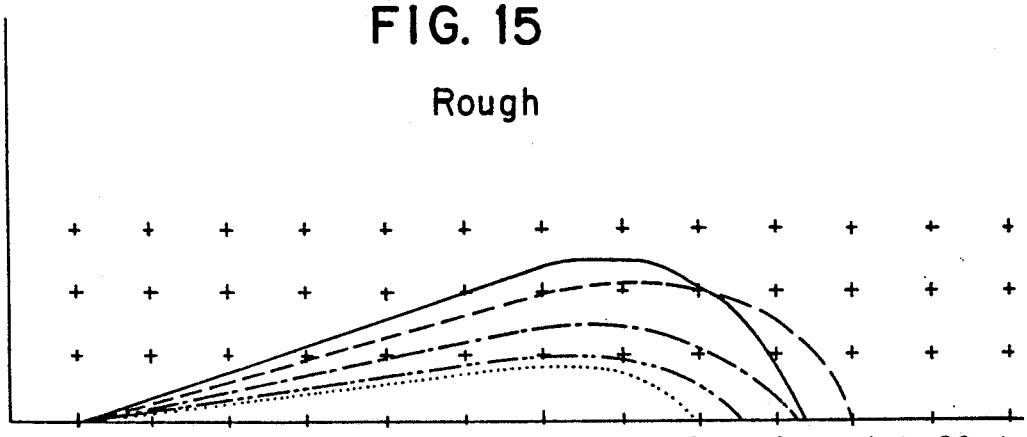
FIG. 15 shows the effect of the degree of rough on the shot trajectory for a golf ball hit with a five iron.
Figure 14:
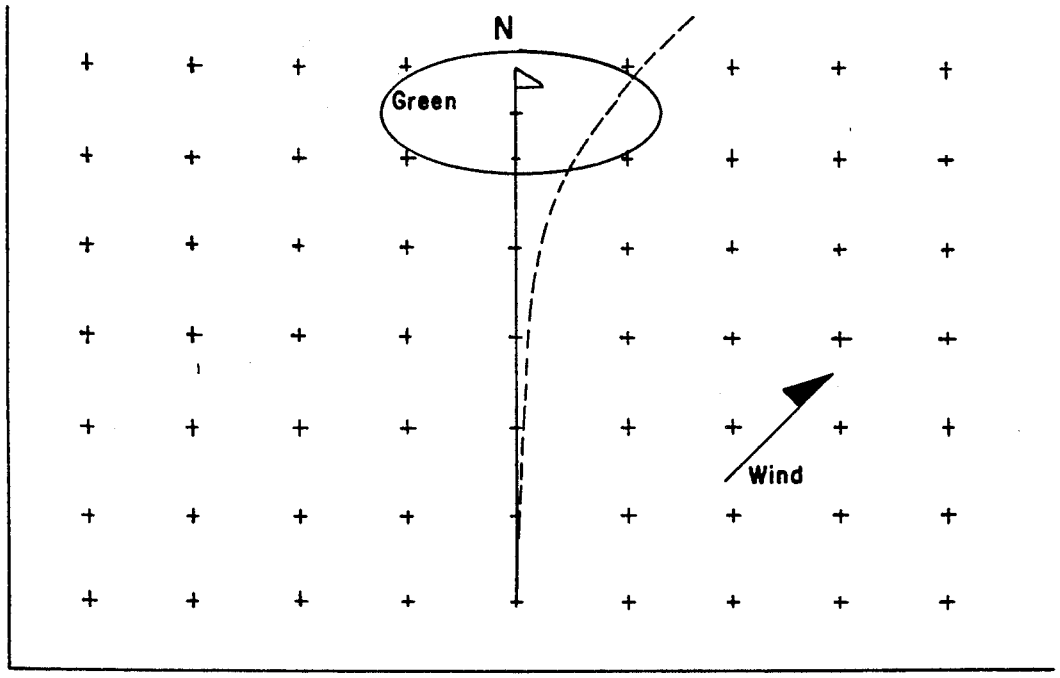
FIG. 14 shows the effect of wind on shot trajectory.

Reference is now made to FIGS. 5–7 for the following explanation of the programming and operation of the device 10. To program the device, the user must turn on power to the device by pushing button 10. If the device is already on, the device need not be turned off, then on again, to program. The user then presses the "Program" button 57 to enter the programming mode. The screen will then display four numbers, one through four. The numbers represent the four datastores 67, 69, 71 and 73 (FIG. 4). The CPU 65 will cause a number to blink on and off if the store it represents has remaining memory capacity, or remain solid if the store it represents has been filled, indicating which stores contain information. A card on the back of the device can be marked to record the user of each store. To enter a store, to input or modify information the user presses the number of the store to be entered on the numeric keypad, and presses the "Enter" button 55. The CPU 65 opens the selected datastore and begins data recording mode. The device displays the store number at the top of the display 59, the current club below that, old stored information on the current club, and at the bottom a "prompt" for new information. The device begins with the one wood, showing "1 WOOD" in the current club section. If the store was previously empty, a zero is displayed in the old information section. The distance the user can hit a ball with the current club, in yards, is entered through the numeric keypad, and displayed on the display screen 59. If the number is incorrect, the user may press the "clear" button 31 to erase the number and re-enter it. If it is correct, the user presses the "Enter" button 55 and the input data is stored to memory. The device then displays information on the next club, the three wood, and information is displayed and entered following the process for the one wood. This cycle is repeated through the five wood, the seven wood, all nine irons starting with the one iron and progressing through to the nine iron, and finishing with the pitching wedge. When "Enter" is pressed to store data to memory on the pitching wedge step, the programming is complete and the programming mode ends. Programming mode may be utilized again at a later time to fill other stores or update previously filled stores.

It should be noted that the user club distances required by the device should be determined at ideal or near-ideal conditions. Ideal conditions are defined as hitting the ball on a level field from a level tee on a day with no wind and a local atmospheric pressure of one atmosphere. It is suggested that a driving range on a windless day is closest to ideal. The user then hits a few balls with each club and finds a good representative distance by whatever statistical means seems most appropriate.

To utilize the device for an approach shot, the user turns on the device and presses the "run" button 74. The device then prompts the user for the set of club ranges to be used. The user presses the number representing the set with his/her statistics in them, and presses "Enter". If an empty store was mistakenly entered, the device will inform the user of this and ask again. After the club ranges are read into temporary memory 71, then the device reads the atmospheric pressure data from the built-in sensor 25 and stores that to temporary memory 71. The device 10 then reads the selected club range data and the pressure data, and uses them to compute and fully define the trajectories of all the clubs, storing this data in temporary storage 71. The device then prompts the user for the distance to the pin.

To find the distance to the pin, the user looks through the focusing lens 15 of the built-in range-finder at the pin. The user then turns the focusing wheel 17 until the images of the pin from the spaced lenses 19, 21 overlap perfectly. When this is done, the user reads the distance from a mechanical scale in the range-finder, and inputs the distance (in yards) to the device using the numeric keypad. Once the correct distance has been inputed, the user presses the "Enter" button 55 and the distance is stored to memory. The device uses this distance and the trajectories of all the clubs as a basis of selection (explained previously), and displays the proper club, along with projected alignment of the shot. The device then prompts on the display 59 for vertical distance.

To find vertical distance, the user stands straight and looks at the pin through the lens. The clinometer reads the level plane. If there is no significant angle, the user presses "Enter", and the device skips to the next step, as the factor is ideal. If there is a significant angle, the user presses the button 39 labeled "Above" in the selection center if the pin is above the ball, or "Below" 41 if the pin is below the ball. The user then inputs the angle from the level, and presses "Enter". The device uses the angle and the true distance (hypotenuse) to trigonometrically compute the height above or below the level. This data then shortens or extends the complete flight path (see FIG. 11), and all trajectories are altered and stored in temporary memory. The true distance and the new trajectories are used as a basis of selection and the proper club is displayed, along with projected alignment. The device then prompts for up/down hill lie.

To find uphill or downhill lie, the user faces toward the ball, positioning his body such that it is perpendicular to the surface the ball lies on, while looking through the eyepiece 15 straight ahead. The device should then be on an angle from the level parallel to that of the ground on which the ball lies. The clinometer will display this angle. If no significant angle is detected, the user presses "Enter" and the device skips to the next step, as the factor is ideal. If there is an angle, the user presses the button labeled "Up" 41 if the ball sits on an uphill lie (where the surface before the ball slopes upward) or "down" 35 if the ball sits on a downhill lie (where the surface before the ball slopes downward). The user then inputs the degree of angle (read from the clinometer) by using the buttons on the selection center marked 5° through 40°, selecting the most appropriate representation. The user's selections are displayed on the screen, and if they are correct the user presses the "Enter" button 55. The device then uses the lie data to alter all the trajectories (see FIG. 12) and the altered trajectories are stored in temporary memory. The true distance and the new trajectories are used as a basis of selection and the proper club is displayed, along with projected alignment. The device then prompts for sidehill lie.

To find sidehill lie, the user stands toward the pin. The user then stands perpendicular to the surface, and looks through the eyepiece 15 straight ahead. The device should now be on an angle from the level plane parallel to that of the ground on which the ball lies. The clinometer will display this angle, in degrees. If no significant angle is detected, the user presses the "Enter" button 55 and the device skips to the next step, as the factor is ideal. If there is an angle the user presses the button 41 in the selection centered labeled "below feet"; if the user's feet are above the ball during the swing, or "above feet" (39) if the user's feet are below the ball during the swing. The user then inputs the angle (read from the clinometer) by using the buttons on the selection center marked 5° through 40°, selecting the most appropriate representation. The user's selections are displayed on the screen, and if they are correct the user presses "Enter". The device then uses the lie data (FIG. 13) to alter all the trajectories and the altered trajectories are stored in temporary memory. The true distance and the new trajectories are used as a basis of selection and the proper club is displayed, along with the projected alignment. The device then prompts for rough.

To determine the rough, the user consults a card (not shown) included with the device, and compares the field in which the ball lies to the categories on the card. The device recognizes five categories, full rough, three-fourths rough, half rough, one-fourth rough, or no rough. No rough is defined as tee or fairway surface. The user then decides what sort of rough the ball is in, pressing "Enter" for no rough, causing the device to skip to the next step, as the factor is ideal. If some degrees of rough exist, the user presses the button in the selection center labeled with the degree of rough the ball lies in. The user's selections are displayed on the screen, and if they are correct the user presses "Enter". The device then uses the rough data (FIG. 15) to alter all the trajectories and the altered trajectories are stored in temporary memory. The true distance and the new trajectories are used as a basis of selection and the proper club is displayed, along with projected alignment. The device then prompts for wind.

To determine wind, the user must estimate wind speed and direction on his own. If the "no wind" is detected the user presses "Enter" and the device ends the process, as the factor is ideal. Final club selection, projected alignment and distance past the pin is displayed by the device until power is lost, or the device is used again. Should the user detect the presence of wind, the user stands facing toward the pin and holds the device before him. The user then compares the direction of the wind relative to this position to the arrows on the circle of buttons on the selection center. For instance, should the wind blow from directly behind him, or away from him, the user selects the button with the arrow pointing away from him, at the top of the circle. Should the wind blow on his face, or directly toward him, the user selects the button on the circle with the arrow pointing toward him, at the bottom. Should the wind blow directly across the user to the right, the user selects the button on the circle with the arrow pointing to the right. Should the wind blow to the right and away from the user, the user selects the button on the circle with the arrow pointing diagonally to the right and away. Other possible directions follow the above examples. The user then estimates the wind speed (in miles per hour) and inputs to the device using the numeric keypad. The user's selections are displayed on the screen, and if they are correct the user presses "Enter". The device then uses the wind data (FIG. 14) to alter all the trajectories and the altered trajectories are stored in temporary memory. The true distance and the new trajectories are used as a basis of selection and the proper club is displayed, along with projected alignment and the distance past the pin that the ball should stop. This display remains on the screen until the power is lost or the device is used again.

The device may be used for approach shots to points other than to the pin. For approach shots to a crucial intermediate point on the fairway, especially on long holes with a dogleg, the device may be used by replacing the pin with a point on the fairway as the focusing point. With this substitution, the user then uses the device to find the proper approach to this point as described above.

Accordingly, an invention has been disclosed in terms of a preferred embodiment thereof which fulfills each and every one of the objects of the invention as set forth hereinabove and provides a new and improved portable golf shot analyzer and club selector of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

We claim:

1. A portable golf shot analyzer and club selector, comprising:

a) a housing having a front face having a multiplicity of actuator buttons;

b) said housing containing first, second and third programmable memories and a central processing unit electrically connected thereto, said first memory being preprogrammed with statistics concerning optimal distance travelled by a golf ball struck by various golf clubs as well as statistics concerning effects of (1) various ambient conditions, (2) various lies and (3) various rough conditions on ball trajectory and distance, said second memory being preprogrammed with statistics concerning actual performance of a particular user using their golf clubs, said third memory being programmed, during play, with current ambient conditions, current ball position on a golf course, current distance to pin, lie angles, rough condition;

c) a display in said housing electrically connected to said central processing unit and displaying inputted data as well as shotmaking instructions;

d) said actuator buttons being electrically connected to said central processing unit and including buttons allowing inputting of information into said central processing unit concerning current ambient conditions, current ball position, current lie angle, elevation with respect to said pin and rough conditions;

e) said central processing unit comparing contents of said first and second memories, analyzing data from said third memory and causing said display to display a preferred club selection as well as the predicted location of a golf ball with respect to said pin after being struck by said preferred club.

2. The invention of claim 1, wherein said ambient conditions include temperature, barometric pressure and humidity.

3. The invention of claim 1, wherein said actuator buttons include a keypad with ten buttons labeled with consecutive numbers 0–9.

4. The invention of claim 1, wherein said actuator buttons include a multiplicity of buttons arranged in a circular pattern, with each such button representing a particular angle of wind direction, a particular angle of lie or a particular angle toward said pin.

5. The invention of claim 4, wherein an "ENTER" button is provided on said front face within said circular pattern and may be pushed to enter data into said third memory which has been displayed by pushing one or more of said buttons in said circular pattern.

6. The invention of claim 1, wherein said housing contains a combined range-finder and elevation calculator including a focusing eyepiece and two spaced lenses optically connected thereto, a focusing dial surrounding said eyepiece being manipulated to determine range to said pin as well as elevation with respect thereto.

7. The invention of claim 6, wherein said eyepiece is mounted on a side face of said housing, said lenses being mounted on a further parallel side face.

8. The invention of claim 6, wherein said side face and further side face are perpendicular to said front face.

9. The invention of claim 6, wherein said further side face has a recess therein comprising an electrical receptacle detachably receiving a memory cartridge comprising a fourth programmable memory.

10. The invention of claim 9, wherein said fourth programmable memory is programmed with instructional program material.

11. The invention of claim 1, wherein said central processing unit is preprogrammed to cause selection of a said preferred club which will cause a said predicted location to be at least slightly beyond said pin.

* * * * *